US011641699B2

(12) United States Patent
Pirlo et al.

(10) Patent No.: US 11,641,699 B2
(45) Date of Patent: May 2, 2023

(54) TEMPERATURE CONTROLLED ELECTROSPINNING SUBSTRATE

(71) Applicant: The Government of the United States of America, as represented by the Secretary of the Navy, Arlington, VA (US)

(72) Inventors: Russell Kirk Pirlo, Oakwood, OH (US); Joel D. Gaston, Alexandria, VA (US)

(73) Assignee: The Government of the United States of America, as represented by the Secretary of the Naw, Washington, DC (US)

( * ) Notice: Subject to any disclaimer, the term of this patent is extended or adjusted under 35 U.S.C. 154(b) by 0 days.

(21) Appl. No.: 17/488,738

(22) Filed: Sep. 29, 2021

(65) Prior Publication Data

US 2022/0022287 A1 Jan. 20, 2022

Related U.S. Application Data

(62) Division of application No. 15/952,174, filed on Apr. 12, 2018, now Pat. No. 11,160,143.

(60) Provisional application No. 62/484,513, filed on Apr. 12, 2017.

(51) Int. Cl.

| | |
|---|---|
| ***H05B 3/40*** | (2006.01) |
| ***D01D 5/00*** | (2006.01) |
| ***H05B 3/64*** | (2006.01) |

(52) U.S. Cl.

CPC ..... *H05B 3/40* (2013.01); *D01D 5/0015* (2013.01); *D01D 5/0061* (2013.01); *D01D 5/0076* (2013.01); *H05B 3/64* (2013.01); *H05B 2213/03* (2013.01)

(58) Field of Classification Search

CPC .. D01D 5/0007; D01D 5/0015; D01D 5/0023; D01D 5/003; D01D 5/0038; D01D 5/0061; D01D 5/0076; D01D 5/0092; H05B 3/40; H05B 3/64; H05B 3/68; H05B 2213/03

USPC ..... 219/460.1, 461.1, 463.1, 465.1, 467.1, 219/468.1, 468.2, 469

See application file for complete search history.

(56) References Cited

U.S. PATENT DOCUMENTS

2005/0040155 A1* 2/2005 Kurara ..... H01L 21/67109 219/444.1
2007/0039943 A1* 2/2007 Burr ..... B29C 45/73 219/461.1

(Continued)

*Primary Examiner* — Hung D Nguyen
(74) *Attorney, Agent, or Firm* — US Naval Research Laboratory; Joseph T. Grunkemeyer

(57) ABSTRACT

A device having: an article having a flat surface and a lower surface opposed to the flat surface; a cavity formed in the lower surface forming a complete loop surrounding a central portion of the article; a heating element having the same shape as the complete loop in the cavity and positioned to warm a portion of the flat surface adjacent to the heating element when the heating element is activated; a cooling device positioned to cool a portion of the flat surface in the central portion; and a release layer on the flat surface. A device having: an article having an upper surface; a heating element on the upper surface forming a complete loop surrounding a central portion of the article; and an electrically insulating material on the upper surface within the central portion.

10 Claims, 6 Drawing Sheets

(56) References Cited

U.S. PATENT DOCUMENTS

2008/0217319 A1* 9/2008 Saule ..... H01L 21/67248
219/465.1
2008/0237216 A1* 10/2008 Goto ..... H05B 3/143
219/461.1
2016/0289865 A1* 10/2016 Park ..... B29C 48/0021

* cited by examiner

TEMPERATURE CONTROLLED ELECTROSPINNING SUBSTRATE

This application is a divisional application of U.S. application Ser. No. 15/952,174, filed on Apr. 12, 2018, which claims the benefit of U.S. Provisional Application No. 62/484,513, filed on Apr. 12, 2017. These applications and all other publications and patent documents referred to throughout this nonprovisional application are incorporated herein by reference.

TECHNICAL FIELD

The present disclosure is generally related to devices used in electrospinning and/or heat sealing.

DESCRIPTION OF RELATED ART

Electrospun mats or biopapers, such as those described in US Pat. Appl. Pub. No. 2017/0183622 and U.S. Pat. No. 8,669,086, are useful for many cell culture processes (Bischel et al., "Electrospun gelatin biopapers as substrate for in vitro bilayer models of blood-brain barrier tissue" *J. Biomed. Mat. Res. A,* 104(4), 901-909). However, fundamental aspects such as their thin profile and degradable nature make them very delicate. They are not easily sealed to devices using standard ultrasonic horns, as the vibrations damage the biopapers. The biopapers can be sealed with precise application of heat, but the application has to be only applied to small areas where bonding is desired. Furthermore, too much heat in either intensity or duration will degrade the paper and ruin its function. This process when done by hand is time consuming, increasing cost and limiting scalability.

BRIEF SUMMARY

Disclosed herein is a device comprising: an article having a flat surface and a lower surface opposed to the flat surface; a cavity formed in the lower surface forming a complete loop surrounding a central portion of the article; a heating element having the same shape as the complete loop disposed in the cavity and positioned to warm a portion of the flat surface adjacent to the heating element when the heating element is activated; a cooling device positioned to cool a portion of the flat surface in the central portion; and a release layer on the flat surface.

Also disclosed herein is a device comprising: an article having an upper surface; a heating element disposed on the upper surface forming a complete loop surrounding a central portion of the article; and an electrically insulating material disposed on the upper surface within the central portion.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Disclosed is a biomaterial heat sealing array to heat seal a biomaterial to an appropriate substrate (e.g. plastic frame) in defined geometries by combining resistive heating and fluid cooling. Also disclosed is a device for electrospinning deposition and further such heat sealing.

Figure 1A:
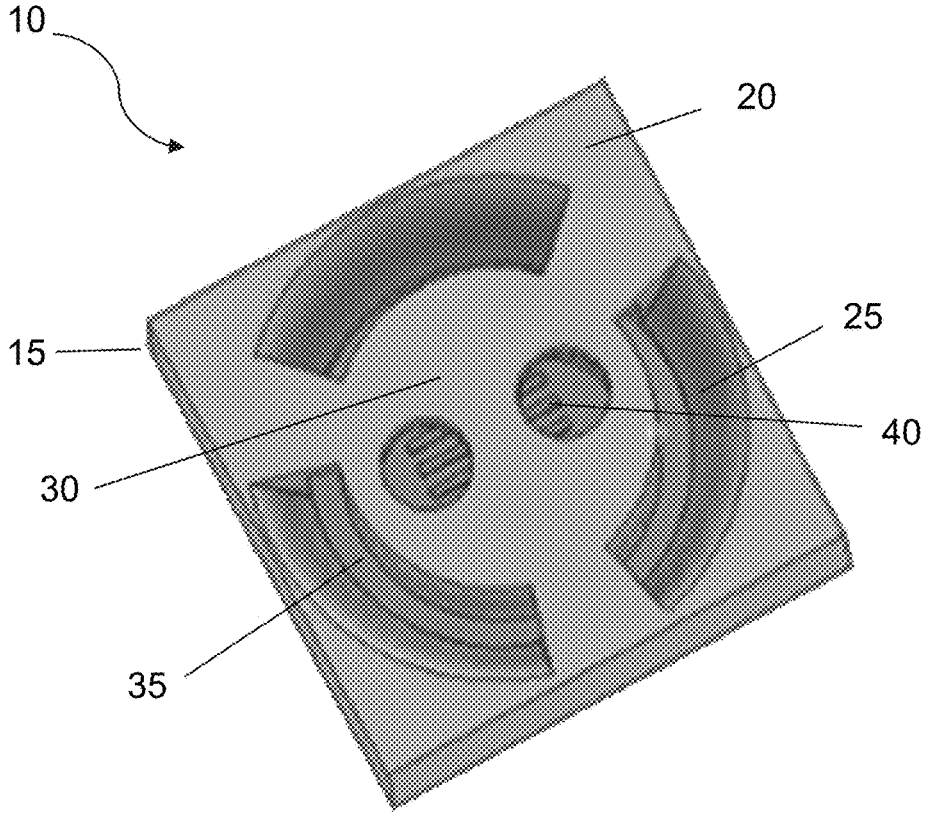
FIG. 1A illustrates a single heat sealing unit and FIG. 1B illustrates an arranged array of sealing units for high-throughput.
Figure 1B:
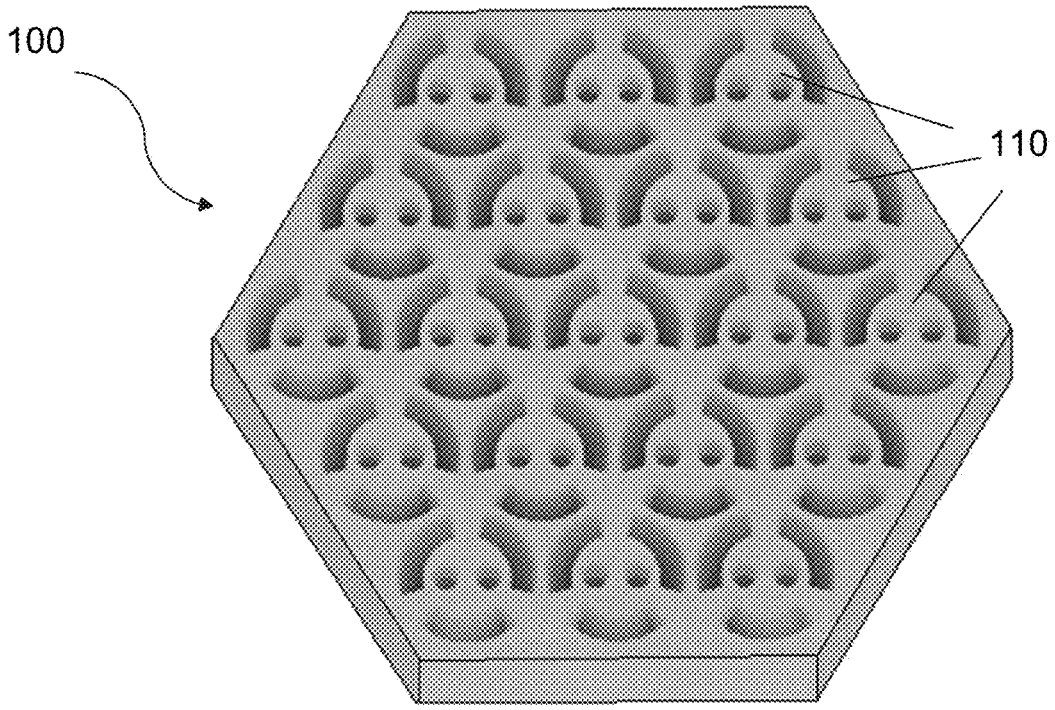

A first embodiment is illustrated in FIGS. 1A-B. Individual heat sealing units (FIG. 1A) may be arranged into an array (FIG. 1B), allowing for high-throughput fabrication of heat-sealed biomaterials. Each individual unit, as well as the array as a whole, may fabricated from a metal or metal alloy. The array may be fabricated from a single piece of material or by individual units placed next to each other (e.g. interlocking). After fabrication, a thin release layer or non-stick coating layer (e.g. PTFE) is added to the bottom of the array. For illustration purposes, a circular geometry for the heat sealing has been shown in all figures however some frames or substrates may have a different geometry, such as for example square, rectangular, or triangular.

FIG. 1A shows device 10 with the article 15 having a lower surface 20. The flat surface is unseen on the other side of the article 15 and has a nonstick release layer, such as polytetrafluoroethylene. The device 10 includes a cavity 25, which defines the geometry of the heat seal, surrounding a circular middle section or central portion 30. A heating element 35 is placed within the cavity 25 to warm the flat surface. A cooling element 40 is within the central portion 30 to cool the flat surface. In this example, the cooling element includes metal cooling fins.

FIG. 1B shows an apparatus 100 having multiple devices 110 formed from a single article. The devices have a common flat surface (not shown).

Figure 2:
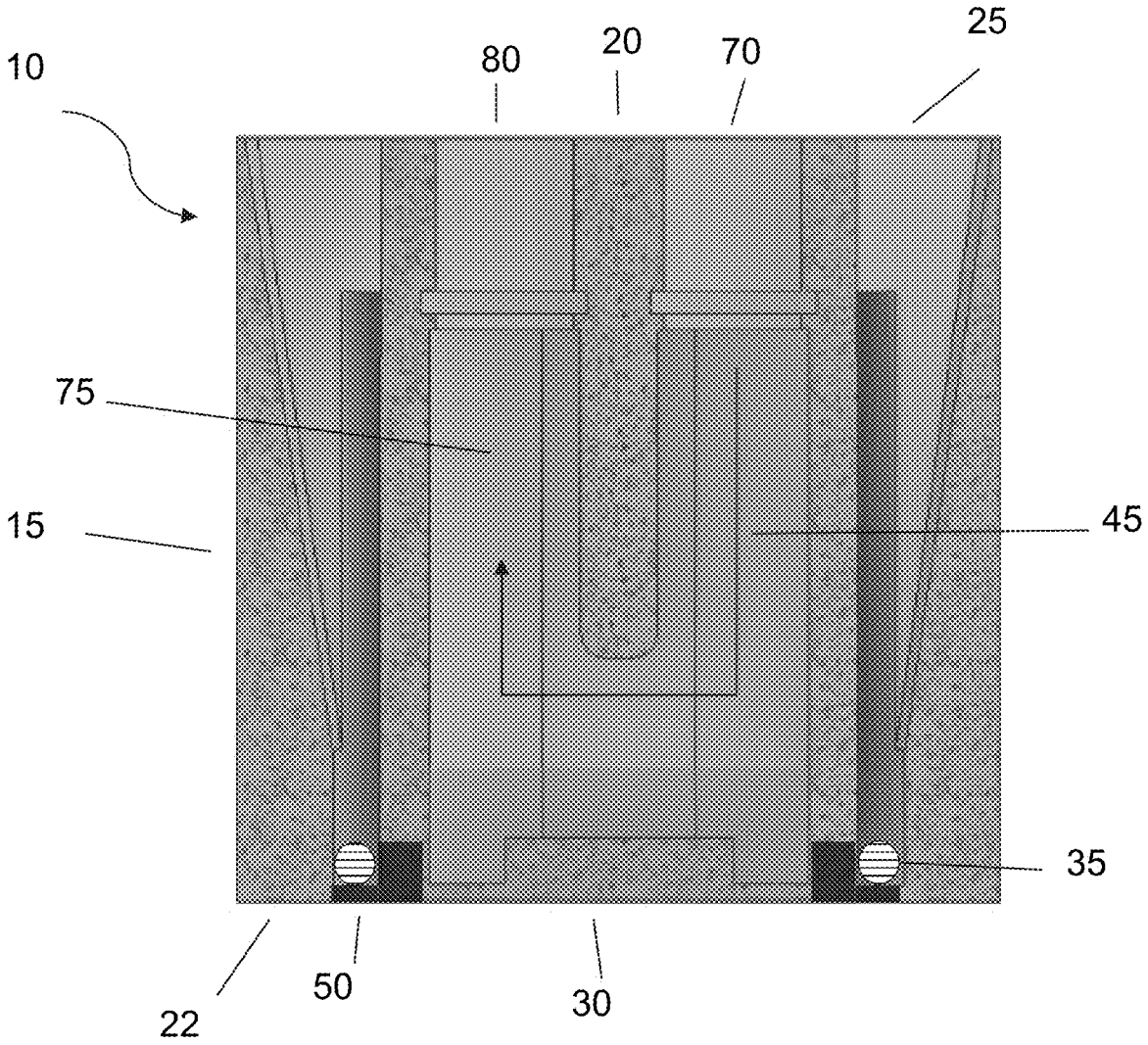
FIG. 2 shows a cross section view (as viewed from the side) of the heat sealing unit.

FIG. 2 shows a vertical cross-section of the device 10 and article 15, with the lower surface shown 20 at the top and the flat surface 22 shown at the bottom. The cavity 25 extends nearly to the flat surface 22 surrounding the central portion 30, with the heating element 35 at the bottom. The cooling element includes the flow of a coolant 45 through a coolant inlet 70, a hollow chamber 75 over the central portion 30, and a coolant outlet 80. The black area 50 is heated by the heating element 35.

In this example, the outer cavity is a circle. The outer cavity has an electrically insulated resistive heating wire laid within the continuous loop. To heat seal the biomaterial, a current is passed through the wire, transferring heat from the wire to the metal alloy of the heat sealing unit. Heat transfer is primarily through conduction, passing through the thin metal between the outer cavity and the bottom of the heat sealing unit. Heat transferred from the resistive wire to the interior area of the outer cavity is dispersed by fluid cooling in the middle section. The middle section consists of two holes in which a fitting can be placed, and through which a fluid coolant (water or another coolant) may flow. The fitting holes connect tubing located outside of the unit to a hollow chamber, which directs the path of the fluid coolant. Coolant is circulated by means of a fluid pump; the coolant flows through the tubing, into the hollow chamber, and then back out of the chamber in a closed circuit. The bottom surface of the hollow chamber has several solid metal cooling fins designed to transfer heat from the metal to the fluid coolant. An alternative arrangement could use a thermoelectric cold plate (e.g. Peltier cooling with heat conducting fingers cooling the center area rather than fluid cooling) with electrical connections and an insulating material between cooling fingers and heat coils.

Figure 3:
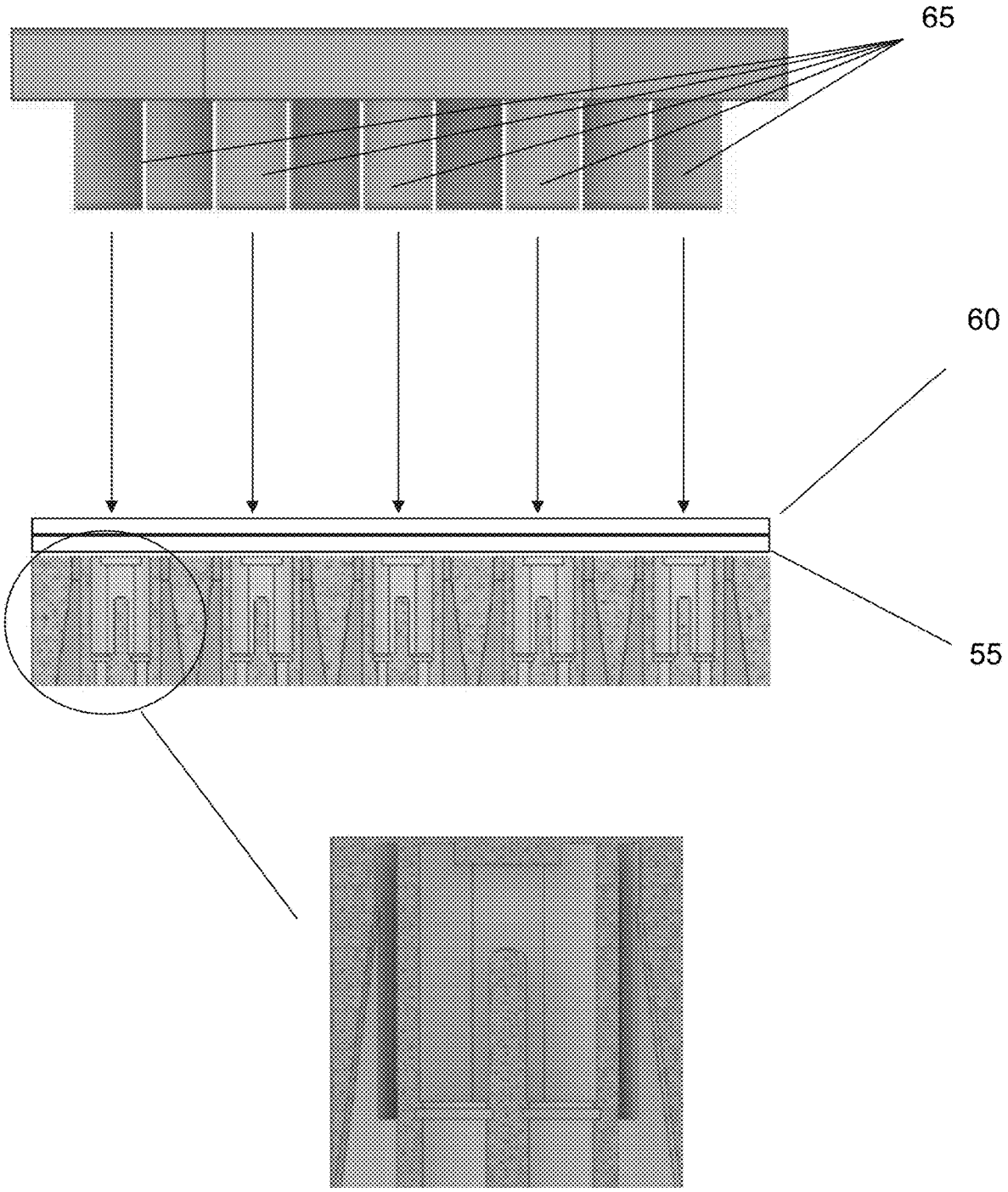
FIG. 3 shows a heat sealing process of deposited biomaterial to substrate.

The process consists of depositing the biomaterial to be sealed to the flat surface of the heat sealing array, on top of the non-stick coating, as shown in FIG. 3. The deposition method may be by electrospinning. Alternatively, an already-formed membrane, such as those disclosed in US Pat. Appl. Pub. No. 2017/0183622 and U.S. Pat. No. 8,669,086, may be placed onto the flat surface. Such membranes may have a porous polymeric film permeated by a first extracellular matrix material and a topcoat layer comprising a second extracellular matrix gel disposed on the film. The substrate 65 to which the biomaterial 60 will be sealed is positioned above the heat sealing array, lowered, and placed in direct contact with the biomaterial. The depicted substrate 65 has a number of transwell inserts whose edges align with the heating regions of the array. Electrical current is supplied to the (insulated) resistive heating wire in the outer cavity of each heat sealing unit in the array, while the cooling element is activated. The shape, timing, and amperage of the current pulse can all be tuned to affect the desired surface temperature required for optimal heat sealing. Simultaneously, fluid coolant will be pumped through the middle section, causing the outer rim to be heated, while the inner circle is cooled. This causes sealing to the substrate in the heated section, while the cooled section remains unsealed. The release layer 55 allows for removing the sealed biomaterial from the flat surface.

Figure 4:
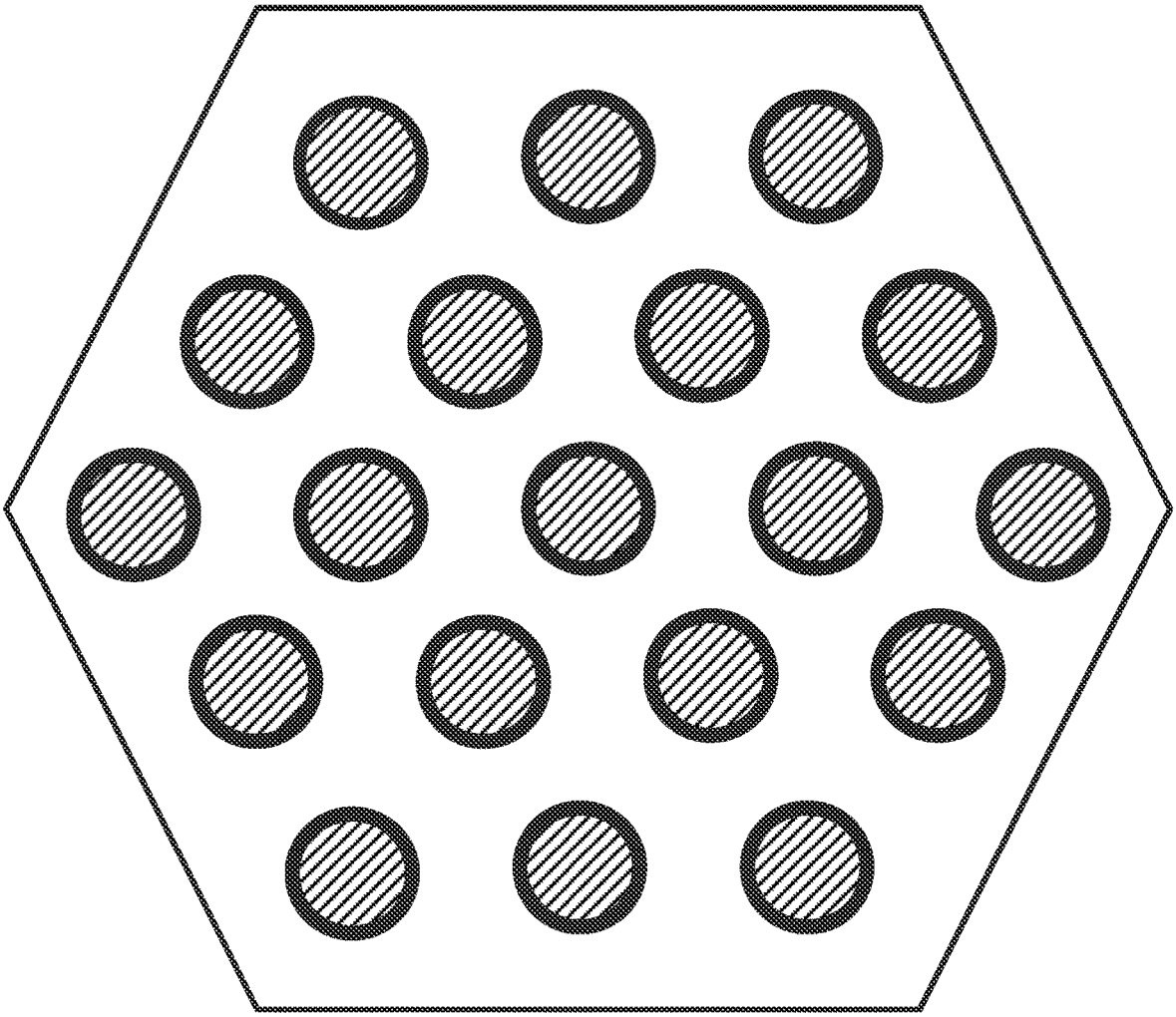
FIG. 4 shows the flat surface of an array.

FIG. 4 shows the flat surface of an array. The heated sections (black) are defined by electrical current flowing through the insulated wire. Cooled regions (lined), caused by fluid coolant, confine the transfer of heat to only the defined circular geometry. This image illustrates only the temperature profile; the actual surface is flat and unmarked, providing a uniform receiving substrate for electrospinning or for a prefabricated membrane.

Figure 5:
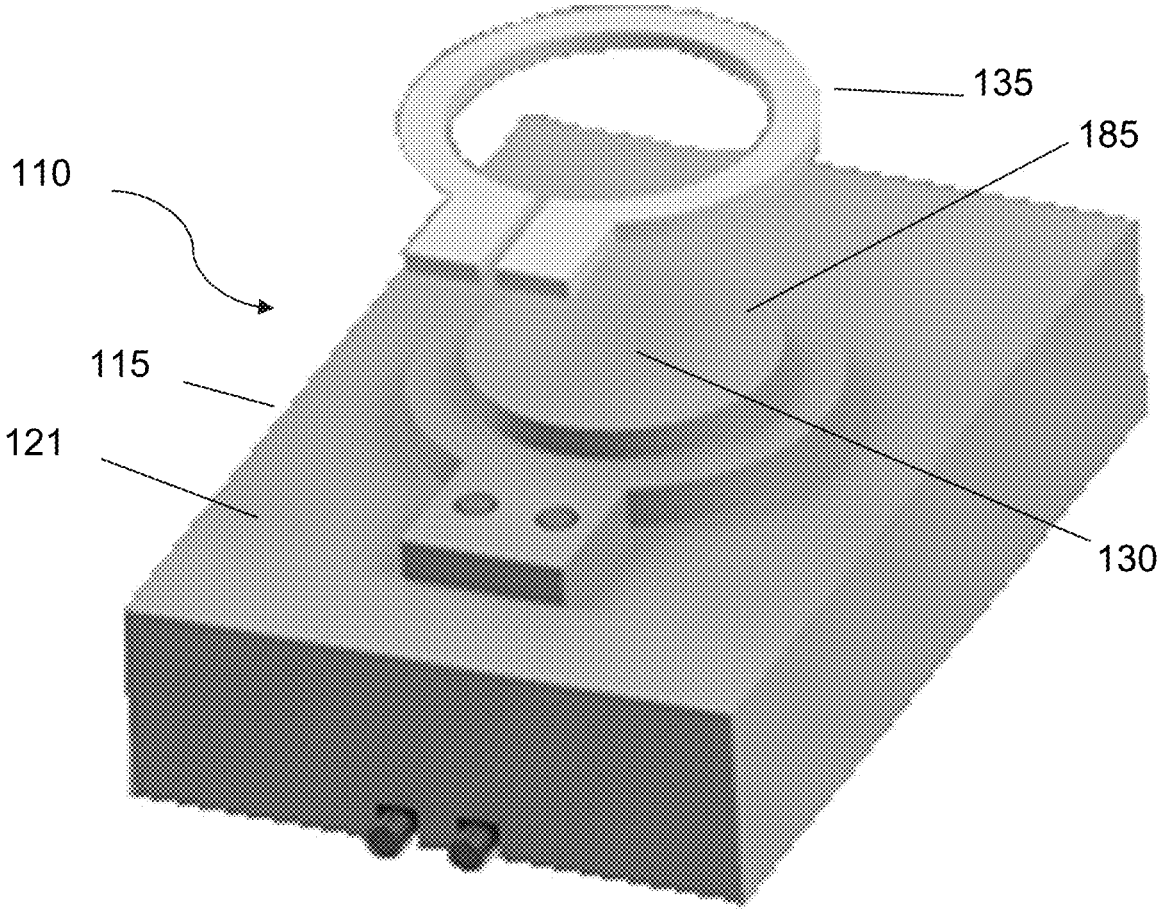
FIG. 5 shows an alternative arrangement of the device.

FIG. 5 illustrates a second embodiment of a device 110 where the relevant features are on an upper surface 121 of an article 115. A heating element 135 as described above (shown before placement) is disposed on the upper surface 121 around the central portion 130. An electrically insulating material 185 is on the central portion 130 to prevent the heating element 135 from short-circuiting across the central portion 130. The article 115 and/or the electrically insulating material 185 may comprise a polymer, as electrical isolation between multiple devices in an array may be needed. A cooling element (not shown) such as a thermoelectric material, may be positioned under the central portion 130.

Figure 6:
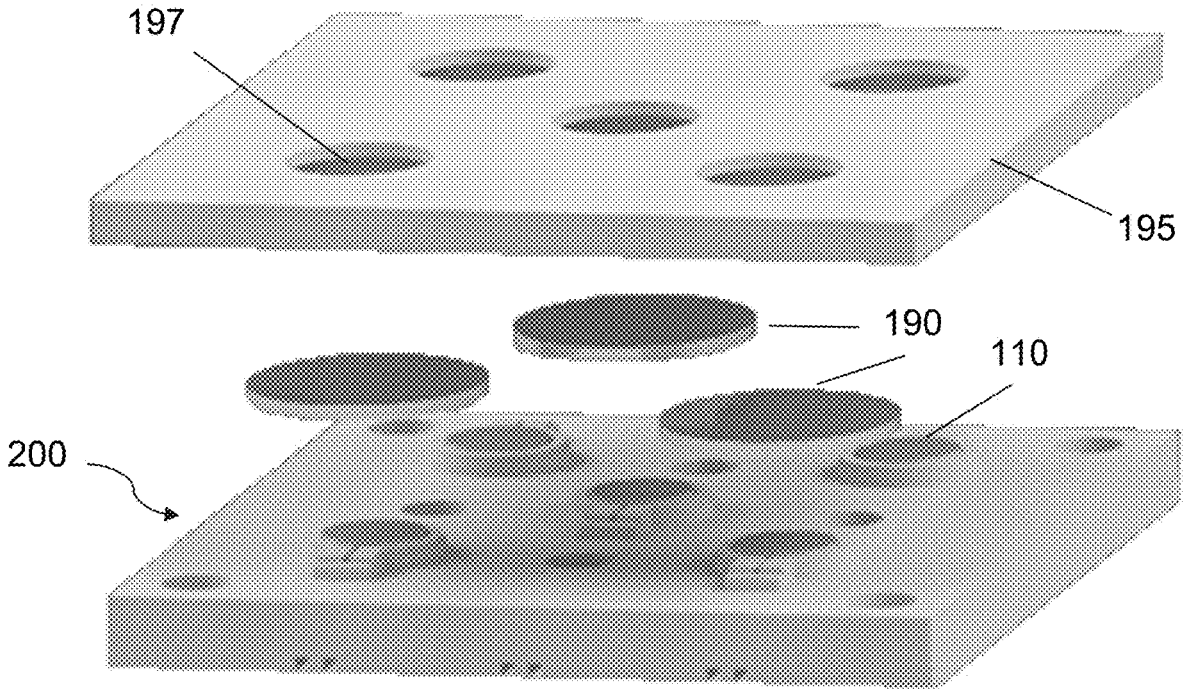
FIG. 6 shows an array of the devices with electrospinning substrates and a mask.

FIG. 6 shows an array 200 of the devices 110, which may be formed from a single article or may be separate devices attached to each other. Such an array, or a single device, may be used by placing an electrically conducting substrate 190 on each heating element and the electrically insulting material. The electrically conducting substrates 190 may be grounded through the heating elements so that they may receive electrospun material. An electrically insulting mask 195 having one or more holes 197 are placed on the electrically conducting substrate 190. The holes 197 are positioned over the electrically conducting substrates 190. A membrane of biocompatible material is then electrospun over the entire array 200, after which the mask 195 may optionally be removed. As described above, a substrate is then applied to the membrane(s) and the heating and any cooling elements are activated to heat seal the membrane(s) to the substrate(s).

A potential advantage is the ability to more uniformly create heat sealed biopaper constructs, and do so more quickly, at higher volume and with less effort. Through the use of materials with high thermal conductivity (e.g. metal) and small surface area/volume ratios, heat can be transferred quickly to the defined heat sealing pattern, drastically decreasing the amount of time needed for complete sealing. The ability to heat seal multiple substrates at once greatly increases the volume that can be produced in a given time compared to manual methods. As currently described, the heat sealing process requires little human intervention; the biomaterial deposition, heat sealing, and fluid cooling can all be controlled through automated processes.

The overall design may be highly adaptable, and may be easily altered to fit a number of different heat sealing geometries, biomaterials, and deposition methods. Different biomaterials may require different temperatures for heat sealing, which can be simply controlled by varying the electrical current supplied to the resistive heating wire. The heat sealing array could also be revised for other deposition methods, such as extrusion bioprinting (Ozbolat et al., "Current advances and future perspectives in extrusion-based bioprinting" *Biomaterials,* 76, 321-343 (2016)) or microcontact printing (Qin et al., "Soft lithography for micro- and nanoscale patterning" *Nature Protocols,* 5(3), 491-502 (2010)), amongst others. The only constraint of the deposition process is that it produces a uniform layer of the biomaterial over a defined area. The implementation of individual heat sealing units clustered into an array provides the potential for high scalability, as the deposition area can be as large or small as desired.

The scalability heat sealing array design and process may be particularly attractive for commercial applications. The primary costs and constraints are associated with the design of the heat sealing geometry and the size of the array. Once the geometry design has been finalized and the array fabricated, the device can be repeatedly used indefinitely. Much like commercial plastic injection molding, the price per heat sealed unit will drastically decrease as higher volumes are needed.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A device comprising:

an article having an upper surface;

a heating element disposed on the upper surface forming a complete loop surrounding a central portion of the article; and an electrically insulating material disposed on the upper surface within the central portion.

2. The device of claim 1, wherein the heating element and the electrically insulting material form a raised area above or recessed area below other portions of the upper surface.

3. The device of claim 1, wherein the heating element is a resistive heating wire.

4. The device of claim 1, wherein the complete loop has a circular shape.

5. The device of claim 1, wherein the article comprises a polymer.

6. The device of claim 1, wherein the electrically insulating material comprises a polymer.

7. The device of claim 1, wherein the article comprises:

a thermoelectric material positioned to cool the central portion; and electrical connections to the thermoelectric material.

8. An apparatus comprising:

an article having an upper surface; and a plurality of devices, each device comprising:

a heating element disposed on the upper surface forming a complete loop surrounding a portion of the article; and an electrically insulating material disposed on the upper surface within the portion.

9. An apparatus comprising:

a plurality of devices, each device comprising:

an article having an upper surface;

a heating element disposed on the upper surface forming a complete loop surrounding a central portion of the article; and an electrically insulating material disposed on the upper surface within the central portion;

wherein the devices are attached to each other to form the apparatus.

10. A method comprising:

providing the device of claim 1;

placing an electrically conducting substrate on the heating element and the electrically insulting material;

placing an electrically insulting mask having a hole on the electrically conducting substrate;

wherein the hole is positioned over the electrically conducting substrate;

electrospinning a biocompatible membrane onto the electrically conducting substrate;

applying a substrate to the membrane; and activating the heating element to bond a portion of the membrane adjacent to the heating element to the substrate.

* * * * *